US005565963A

United States Patent [19]

Tsujita et al.

[11] Patent Number: 5,565,963

[45] Date of Patent: Oct. 15, 1996

[54] IMAGE FORMING APPARATUS CAPABLE OF CHANGING THE SURFACE POTENTIAL OF A PHOTOSENSITIVE MEMBER

[75] Inventors: Mitsuji Tsujita; Nariaki Tanaka; Yuji Tanaka; Takashi Terada; Takuji Terada, all of Osaka, Japan

[73] Assignee: Mita Industrial Co., Ltd., Osaka, Japan

[21] Appl. No.: 423,551

[22] Filed: Apr. 17, 1995

[30] Foreign Application Priority Data

May 31, 1994 [JP] Japan ..... 6-119321

[51] Int. Cl.[6] ..... G03G 15/02

[52] U.S. Cl. ..... 355/208; 347/140; 355/219

[58] Field of Search ..... 355/208, 214, 355/216, 219, 220; 361/229; 347/130, 140

[56] References Cited

U.S. PATENT DOCUMENTS

| | | | |
|---|---|---|---|
| 4,248,519 | 2/1981 | Urso | 355/214 |
| 4,350,435 | 9/1982 | Fiske et al. | 355/214 X |
| 4,542,981 | 9/1985 | Anzai et al. | 355/220 |
| 5,164,776 | 11/1992 | Oresick et al. | 355/208 |
| 5,331,379 | 7/1994 | Yoneda et al. | 355/214 |
| 5,392,098 | 2/1995 | Ehara et al. | 355/219 X |

FOREIGN PATENT DOCUMENTS

| | | |
|---|---|---|
| 0547611 | 6/1993 | European Pat. Off. . |
| 61-018975 | 1/1986 | Japan . |
| 97680 | 5/1986 | Japan . |
| 8501594 | 4/1985 | WIPO . |

OTHER PUBLICATIONS

Search Report for European Appl. 95302745.5, mailed Sep. 21, 1995.

*Primary Examiner*—Joan H. Pendegrass
*Assistant Examiner*—Quana Grainger
*Attorney, Agent, or Firm*—Renner, Otto, Boisselle & Sklar

[57] ABSTRACT

An image forming apparatus includes a rotatable photosensitive member including a conductive base and a photosensitive layer located on a surface of the base; a charging device located in the vicinity of the photosensitive member for charging the photosensitive layer; a charge removing device located upstream with respect to the charging device in a rotation direction of the photosensitive member for radiating light toward the photosensitive layer prior to charging performed by the charging device to uniformize a surface potential of the photosensitive layer; a light radiation device for radiating light to a charging area of the photosensitive layer in the state of being charged by the charging device and for adjusting the amount of the light to be radiated; an exposing device for radiating light corresponding to an image toward the photosensitive layer in the state of being charged; a developing device located downstream with respect to the exposing device in the rotation direction of the photosensitive member; a change detection device for detecting a change in at least one of a charging potential of the photosensitive layer and a sensitivity of the photosensitive layer; and a compensation device for compensating for the change by adjusting the amount of the light radiated toward the charging area by the light radiation device based on results obtained by the change detection device.

19 Claims, 12 Drawing Sheets

IMAGE FORMING APPARATUS CAPABLE OF CHANGING THE SURFACE POTENTIAL OF A PHOTOSENSITIVE MEMBER

BACKGROUND OF THE INVENTION

1. Field of the Invention

The present invention relates to an image forming apparatus using an electrophotographic technology. In particular, the present invention relates to an image forming apparatus forming an image by charging and exposing a single-layer organic photosensitive drum to light.

2. Description of the Related Art

Conventionally, image forming apparatuses using electrophotographic technologies have been actively developed for use as electrostatic copiers or printers.

Briefly referring to FIG. 15, a conventional image forming apparatus 1 using an electrophotographic technology will be described. An image forming apparatus 1 includes a rotatable photosensitive drum 3 having a photosensitive layer 2 located on a surface thereof, a main charger 4 for uniformly supplying the photosensitive layer 2 with a prescribed level of electric charge, an optical device 5 for exposing the photosensitive layer 2 to light and forming an electrostatic latent image on the photosensitive layer 2, a developing device 6 for developing the electrostatic latent image formed on the photosensitive layer 2 into a toner image, a transfer device 8 for transferring the toner image on the photosensitive layer 2 onto a recording paper sheet 7, a cleaning device 9 provided with a cleaning blade for removing the residual toner on the photosensitive layer 2, and a charge removing lamp 10 for removing the residual charge on the photosensitive layer 2 and thus setting the surface potential of the photosensitive layer 2 at a prescribed uniform level. The main charger 4 includes a discharge wire **4*b* for performing corona discharge to the photosensitive film 2 and a sealed case 4*a* surrounding the discharge wire 4*b* and opened toward the photosensitive layer 2**.

In the image forming apparatus 1 having the above-described structure, an image is formed in the following manner.

First, the main charger 4 uniformly supplies the photosensitive layer 2 with a prescribed level of electric charge. Next, light is radiated to the photosensitive layer 2 by the optical device 5, thereby forming an electrostatic latent image on the photosensitive layer 2. Then, toner is supplied to the photosensitive layer 2 by the developing device 6, thereby developing the electrostatic latent image into a toner image. The toner image on the photosensitive layer 2 is transferred to the recording paper sheet 7 by the transfer device 8. After the transference, the residual toner on the photosensitive layer 2 is removed by the cleaning device 9. Light is radiated on the photosensitive layer 2 by the charge removing lamp 10, thereby removing the residual charge on the photosensitive layer 2. Thus, the surface potential of the photosensitive layer 2 is uniformly set at a prescribed level. Thereafter, the photosensitive layer 2 is charged again by the main charger 4. Such a process is repeated in accordance with the rotation of the photosensitive drum 3.

It is known that a surface potential of the photosensitive layer 2 obtained by charging by the main charger 4 differs among different production lots because the electric characteristics of the photosensitive layer 2 of the photosensitive drum 3 differs among different production lots. In detail, the photosensitive layer 2 is exposed to light corresponding to a white area (non-image area) of a document after the surface potential of the photosensitive layer 2 is uniformly set. The surface potential of the photosensitive layer 2 corresponding to the white area obtained at a developing position differs among different production lots. Such non-uniformity in the surface potential of the photosensitive layer 2 causes a difference in the density of an image formed on the recording paper sheet 7 among different production lots.

In order to prevent such a problem, a light radiation apparatus C shown in FIG. 16 is conventionally used. The light radiation apparatus C includes a lamp B and a case A surrounding the lamp B and opened toward the photosensitive layer 2. Light is radiated by the light radiation apparatus C toward a charging area **24*c* of the photosensitive layer 2, thereby adjusting the surface potential of the photosensitive layer 2 so that the surface potential will be uniform even among different production lots. In general, where the surface potential of the photosensitive layer 2 provided by the main charger 4 is uniform, as the amount of light radiated by the light radiation apparatus C is larger, the surface potential of an area D irradiated by the light is lower. By adjusting the amount of light radiated by the light radiation apparatus C in accordance with the photosensitive characteristic of the photosensitive layer 2, the surface potential of the photosensitive layer 2 at the developing position can be uniform even among different production lots before the image on the photosensitive layer 2 is developed by the developing device 6**.

However, the light radiation apparatus C does not function effectively when a different material is used for the photosensitive layer 2. The photosensitive layer 2 may be made of an inorganic photoconductive material, such as Se, or a single-layered or multiple-layered organic photoconductive material. The inventors of the present invention have found that the relationship between the amount of light radiated to the photosensitive layer 2 by the light radiation apparatus C and the surface potential thereof differs, depending on whether the photosensitive layer 2 is formed of an inorganic material or an organic material. FIG. 17 is a graph illustrating such relationship. Line L1 represents such a relationship obtained when the photosensitive layer 2 is formed of an inorganic material, and line L2 represents such a relationship obtained when the photosensitive layer 2 is formed of an organic material. As is appreciated from FIG. 17, where the amount of light radiated by the light radiation apparatus C is relatively small, reduction in the surface potential of the organic photosensitive layer (L2) is greater than such reduction of the inorganic photosensitive layer (L1).

Depending on whether an inorganic material or an organic material is used for the photosensitive layer 2, the amount of light radiated by the optical device 5 required for reducing the potential of the photosensitive layer 2 provided by the main charger 4 to surface potential SP1 is different. For example, such a light amount is E1 in the case of an organic photosensitive layer and E2 in the case of an inorganic photosensitive layer in FIG. 17.

In the conventional image forming apparatus 1 shown in FIG. 16, the amount of light radiated by the optical device 5 cannot be adjusted in accordance with the material of the photosensitive layer 2. Accordingly, the image density on the recording paper sheet 7 differs by the material of the photosensitive layer 2, resulting in reduction in the image quality. Further, it is troublesome to adjust the amount of light from the optical device 5 for each image forming apparatus.

SUMMARY OF THE INVENTION

According to one aspect of the present invention, an image forming apparatus includes a rotatable photosensitive member including a conductive base and a photosensitive layer located on a surface of the base; a charging device located in the vicinity of the photosensitive member for charging the photosensitive layer; a charge removing device located upstream with respect to the charging device in a rotation direction of the photosensitive member for radiating light toward the photosensitive layer prior to charging performed by the charging device to uniformize a surface potential of the photosensitive layer; a light radiation device for radiating light to a charging area of the photosensitive layer in the state of being charged by the charging device and for adjusting the amount of the light to be radiated; an exposing device for radiating light corresponding to an image toward the photosensitive layer in the state of being charged; a developing device located downstream with respect to the exposing device in the rotation direction of the photosensitive member; a change detection device for detecting a change in at least one of a charging potential of the photosensitive layer and a sensitivity of the photosensitive layer; and a compensation device for compensating for the change by adjusting the amount of the light radiated toward the charging area by the light radiation device based on results obtained by the change detection device.

According to another aspect of the present invention, an image forming apparatus includes a rotatable photosensitive member including a conductive base and a photosensitive layer located on a surface of the base; a charging device located in the vicinity of the photosensitive member for charging the photosensitive layer; a charge removing device located upstream with respect to the charging device in a rotation direction of the photosensitive member for radiating light toward the photosensitive layer prior to charging performed by the charging device to uniformize a surface potential of the photosensitive layer; a light radiation device for radiating light to a charging area of the photosensitive layer in the state of being charged by the charging device and for adjusting the amount of the light to be radiated; an exposing device for radiating light corresponding to an image toward the photosensitive layer in the state of being charged; a developing device located downstream with respect to the exposing device in the rotation direction of the photosensitive member; an operation device for outputting an adjusting signal for setting at least one of a charging potential of the photosensitive layer and a sensitivity of the photosensitive layer at one of a plurality of different values determined in advance; and a compensation device for setting at least one of the charging potential of the photosensitive layer and the sensitivity of the photosensitive layer at the one of the plurality of different values determined in advance by adjusting the amount of light radiated toward the charging area by the light radiation device based on the adjusting signal.

According to still another aspect of the present invention, an image forming apparatus includes a rotatable photosensitive member including a conductive base and a photosensitive layer located on a surface of the base; a charging device located in the vicinity of the photosensitive member for charging the photosensitive layer; a charge removing device located upstream with respect to the charging device in a rotation direction of the photosensitive member for radiating light toward the photosensitive layer prior to charging performed by the charging device to uniformize a surface potential of the photosensitive layer; a light radiation device for radiating light to a charging area of the photosensitive layer in the state of being charged by the charging device and for adjusting the amount of the light to be radiated; an exposing device for radiating light corresponding to an image toward the photosensitive layer in the state of being charged; a developing device located downstream with respect to the exposing device in the rotation direction of the photosensitive member; an operation device for outputting an adjusting signal for setting at least one of a charging potential of the photosensitive layer and a sensitivity of the photosensitive layer at one of at least two different values determined in advance; and a compensation device for setting at least one of the charging potential of the photosensitive layer and the sensitivity of the photosensitive layer at the one of the at least two different values by adjusting the amount of light radiated toward the charging area by the light radiation device based on the adjusting signal, at least one of the at least two different values determined in advance being selected so as to change a gamma characteristic of the photosensitive layer with respect to the image.

In one embodiment of the invention, the sensitivity of the photosensitive layer is set at two different values by the compensation device.

In one embodiment of the invention, the sensitivity of the photosensitive layer set by the compensation device is selected from at least three different values.

In one embodiment of the invention, the charge removing device acts as the light radiation device.

In one embodiment of the invention, the light radiation device includes a light emitting device which is different from the charge removing device.

In one embodiment of the invention, the light radiation device generates light as pulses.

In one embodiment of the invention, the charging device includes a discharge member for performing discharge toward the photosensitive layer and a first case surrounding the discharge member and opened toward the photosensitive layer, the light radiation device includes a light emitting member and a second case surrounding the light emitting member and opened toward the charging area of the photosensitive layer, and the first case and the second case are formed of a common material.

In one embodiment of the invention, the compensation device includes a light emission driving device for driving the light radiation device and a light amount setting device for setting the amount of light radiated by the light radiation device.

Thus, the invention described herein makes possible the advantages of providing (1) an image forming apparatus which prevents, without troublesome adjustment, reduction in the image quality caused by, for example, a difference in the material of the photosensitive layer and non-uniformity in the electric characteristics of the photosensitive layer existing among different production lots and accompanying repeated use; and (2) an image forming apparatus which performs various types of image processing during image formation, for example, switching of the operation mode between a photograph mode in which the density of an image formed on a recording paper sheet changes substantially linearly with respect to the density of an original document and a normal mode in which the density of the image formed on the paper changes drastically with respect to the density of the original document in the vicinity of a prescribed density.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings. The present invention is not limited to the following example.

In an image forming apparatus according to the present invention, a photosensitive layer of a photosensitive drum is charged uniformly with a prescribed level of electric charge by a main charger, and then light is radiated toward a charging area of the photosensitive layer by a light radiation device which can adjust the amount of light. Next, light corresponding to an image of a document is radiated by an exposing device to the photosensitive layer, which has been charged by the main charger and irradiated by the light of a prescribed amount from the light radiation device. Thus, an electrostatic latent image is formed on the photosensitive layer. The electrostatic latent image is developed into a toner image by a developing device.

In the image forming apparatus according to the present invention, even in the case where the photosensitive layer is formed of a different material or formed of the same type of material having different electric characteristics, a change amount in the surface potential of the photosensitive layer at a developing position is detected and compensated for. In this manner, the surface potential of the photosensitive layer at the developing position can be uniformized without adjusting the amount of light from the exposing device.

In detail, a change amount in the surface potential of the photosensitive layer at the developing position is first detected. Based on the detection result, an adjusting signal for setting the detected surface potential at one of a plurality of different values determined in advance is generated by an operation device. Based on the adjusting signal, a compensation device adjusts the amount of light radiated from the light radiation device to the charging area of the photosensitive layer to set the surface potential thereof at the developing position at one of the plurality of different values determined in advance. In this manner, the surface potential of the photosensitive layer at the developing position can be uniformized without adjusting the amount of light from the exposing device.

By adjusting the amount of light from the light radiation device, an electrostatic latent image formed on the photosensitive layer by light from the exposing device and a toner image formed by the developing device can be obtained as an image which has already been properly treated in accordance with the conditions of an image of the original document.

EXAMPLE 1

Figure 1:
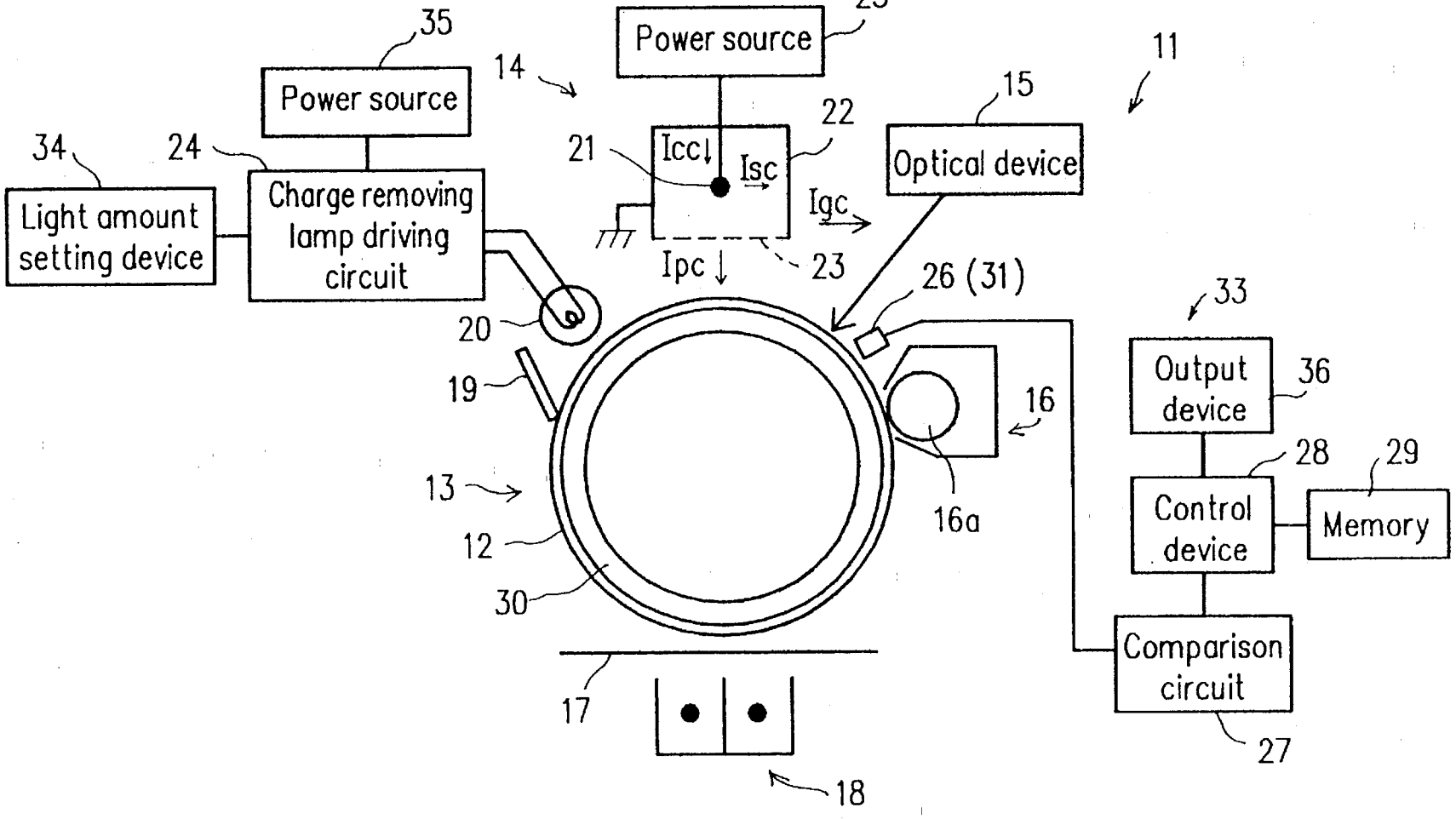
FIG. 1 is a schematic view of an image forming apparatus in a first example according to the present invention.

Referring to FIG. 1, an image forming apparatus 11 in a first example according to the present invention will be described. FIG. 1 is a schematic view of the image forming apparatus 11. As is shown in FIG. 1, the image forming apparatus 11 includes a rotatable photosensitive drum 13 acting as a photosensitive member which includes a drum substrate 30 and a photosensitive layer 12 located on a surface of the drum substrate 30. The photosensitive drum 13 is surrounded by a main charger 14 for uniformly supplying the photosensitive layer 12 with a prescribed level of electric charge, an optical device 15 acting as exposing means for generating light to form an electrostatic latent image on the photosensitive layer 12, a developing device 16 for developing the electrostatic latent image on the photosensitive layer 12 into a toner image, a transfer device 18 for transferring the toner image on the photosensitive layer 12 onto, for example, a recording paper sheet 17, a cleaning device 19 for removing the residual toner on the photosensitive layer 12 after the transference, and a charge removing lamp 20 for removing the residual charge on the photosensitive layer 12 to uniformize the surface potential of the photosensitive layer 12 at a prescribed level.

(Charge removing lamp)

The charge removing lamp 20 for removing the residual charge on the photosensitive layer 12 to uniformize the surface potential of the photosensitive layer 12 at a prescribed level also acts as a light radiation device for radiating light toward the photosensitive layer 12 charged by the main charger 14 when necessary. Hereinafter, the light radiation performed toward the photosensitive layer 12 in the state of being charged will be referred to as "exposure with charging". The exposure with charging is performed in one of the following manners.

(1) Performing charge removal and light radiation in a single step and charging is performed simultaneously.

(2) Performing charging and light radiation simultaneously after charge removal.

(3) Performing light radiation after charge removal and charging.

In the case when the charge removing lamp 20 also acts as the light radiation device, the charge removing lamp 20 is located in the vicinity of the main charger 14 and radiates light toward the photosensitive layer 12 between the main charger 14 and the photosensitive drum 13.

Figure 2:
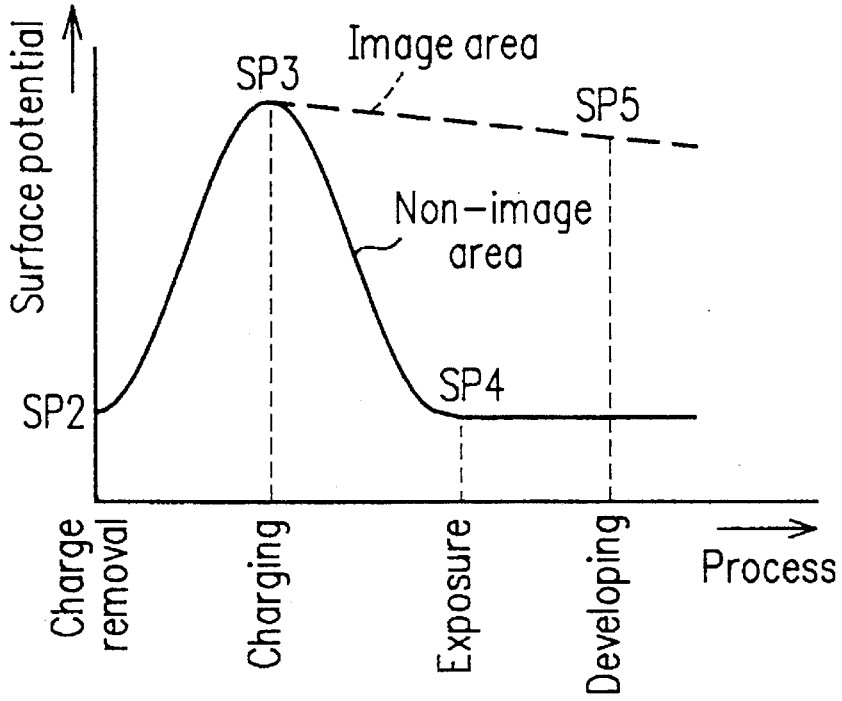
FIG. 2 is a graph illustrating the surface potential of a photosensitive layer in accordance with the image forming procedure.
Figure 3:
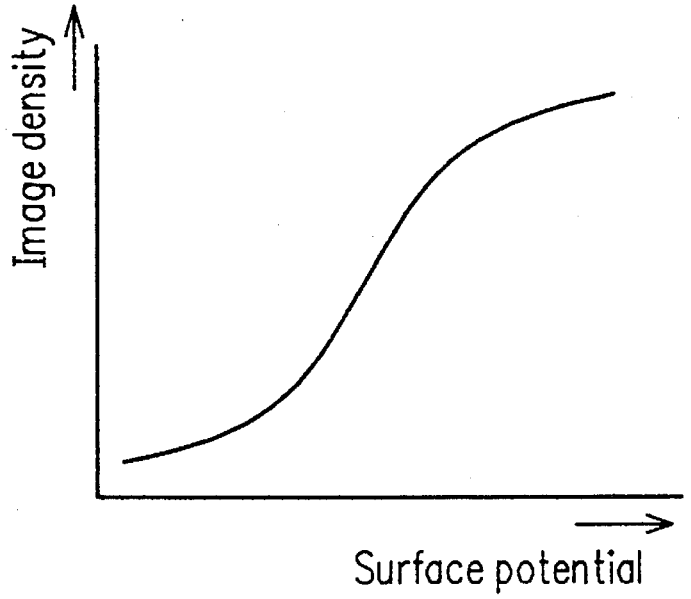
FIG. 3 is a graph illustrating the density of a toner image formed by a developing device in relation with the surface potential of the photosensitive layer at a developing position.

FIG. 2 is a graph illustrating the surface potential of the photosensitive layer 12 in accordance with the image forming procedure. As is illustrated in FIG. 2, when the light is radiated for charge removal by the charge removing lamp 20, the surface potential of the photosensitive layer 12 is SP2. When the photosensitive drum 13 rotates and the photosensitive layer 12 is charged by the main charger 14 at a charging position, the surface potential of the photosensitive layer 12 is increased to SP3. For example, SP3 is approximately 810 V. When the photosensitive layer 12 is exposed to light corresponding to an image of a document by the optical device 15 at an exposing position, the surface potential of an area of the photosensitive layer 12 which is exposed to light corresponding to a white area (non-image area) of the document decreases to SP4. Hereinafter, exposure performed by the optical device 15 will be referred to as "main exposure", and the potential obtained by main exposure will be referred to as a "potential after exposure". The surface potential of an area of the photosensitive layer 12 which has not been exposed to the light corresponding to the white area of the document, namely, the surface potential of an area corresponding to an image area of the document, is SP5. The surface potential of such an area will be referred to as a "charging potential". Toner is supplied to the area having the charging potential by the developing device 16, thereby performing developing. The charging potential SP5 is equal to SP3 or lower than SP3 by a level of dark attenuation. FIG. 3 illustrates the density of an image in relation with the surface potential SP5. As is illustrated in FIG. 3, as the surface potential SP5 increases, the image density rises.

Returning to FIG. 1, the main charger 14 includes a discharge wire 21 for performing corona discharge, a shielding case 22 surrounding the discharge wire 21 and having an opening opposite to the photosensitive drum 13, and a grid 23 formed of metal and located at the opening of the shielding case 22. The discharge wire 21 is connected to the power source 25 for supplying the discharge wire 21 with a necessary amount of current for the corona discharge. The shielding case 22 is grounded. The grid 23 is supplied with a prescribed potential which is between the discharging potential of the discharge wire 21 and the surface potential of the photosensitive layer 12 after charge removal.

A current Icc from a power source 25 flowing to the discharge wire 21 is branched into a discharge current Isc flowing to the shielding case 22, a discharge current Igc flowing to the grid 23, and a discharge current Ipc flowing to the photosensitive drum 13.

The discharge current Ipc, the surface potential SP3 of the photosensitive layer 12 at the charging position, and the surface potential after exposure SP4 were measured when the exposure with charging was performed by the charge removing lamp 20 and when the exposure with charging was not performed. The results are shown in Table 1.

TABLE 1

| | Ipc | SP3 | SP4 |
|---|---|---|---|
| No exposure | 100 μA | 810 V | 250 V |
| Exposure with charging | 115 μA | 950 V | 280 V |

In the case when exposure with charging was performed, the discharge current Ipc, the surface potential SP3, and the surface potential SP4 after exposure were higher than those in the case when exposure with charging was not performed. As is appreciated from these results, the surface potential SP3 of the photosensitive layer 12 at the charging position is higher than the surface potential provided by the main charger 14 when exposure with charging is performed. When exposure with charging was performed, reduction from the charging potential (810 V in Table 1) obtained by the main charger to the surface potential SP4 after exposure was less than such reduction when exposure with charging was not performed. If such reduction is defined as "sensitivity", the sensitivity of the photosensitive layer 12 is lower when exposure with charging is performed than when exposure with charging is not performed.

Figure 4:
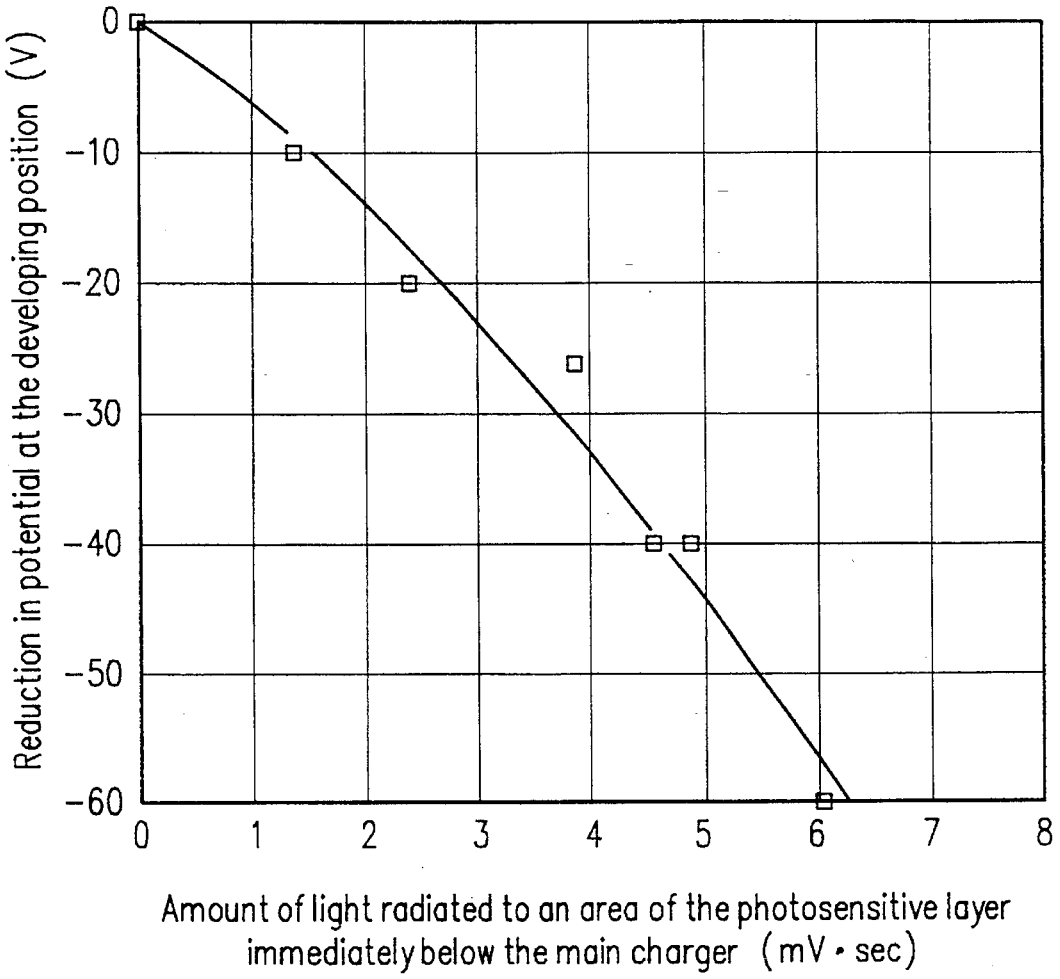
FIG. 4 is a graph illustrating reduction in the surface potential of the photosensitive layer at the developing position in relation with the amount of light radiated by a charge removing lamp.

FIG. 4 is a graph illustrating reduction from the charging potential to the potential at the developing position in relation with the amount of light radiated to an area of the photosensitive layer 12 immediately below the main charger 14 by the charge removing lamp 20. Such an amount of light can be measured using, for example, S1226-BK, which is a photosensor provided with a photodiode produced by Hamamatsu Photonics, Inc. The amount of light (unit: mV·sec.) illustrated in FIG. 4 is obtained by integrating the current detected by the photosensor converted into a voltage by the period of time in which the light is radiated by the charge removing lamp 20. As is appreciated from FIG. 4, exposure with charging performed by the charge removing lamp 20 can reduce the potential at the developing position, and as the amount of light radiated by the charge removing lamp 20 increases, reduction from the charging potential to the potential at the developing position decreases.

Figure 5:
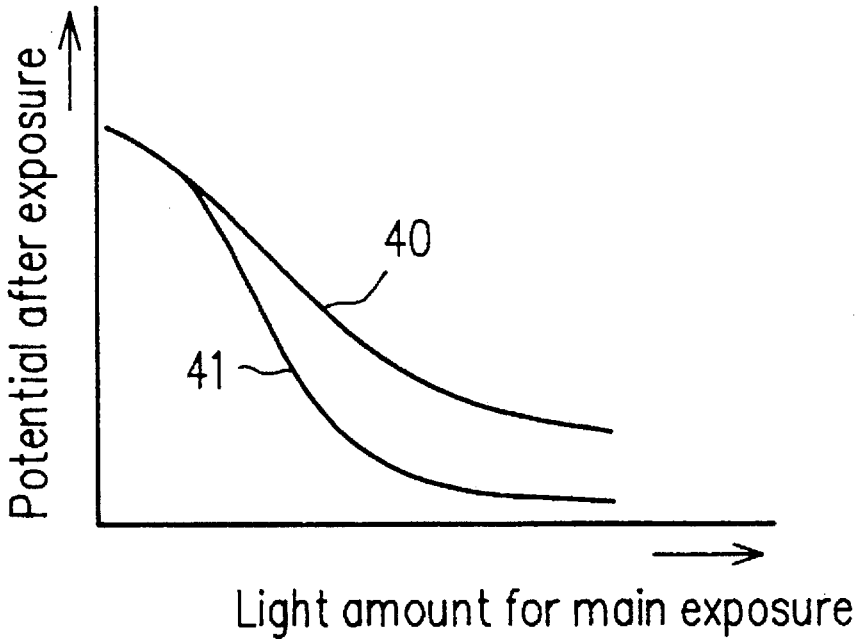
FIG. 5 is a graph illustrating the surface potential of the photosensitive layer after main exposure performed by an optical device in relation with the amount of light for main exposure.

FIG. 5 is a graph illustrating the potential after exposure in relation with the amount of light used for main exposure by the optical device 15 when exposure with charging is performed by a relatively large amount (e.g., 10 mV·sec) of light and when exposure with charging is performed by a relatively small amount (e.g., 3 mV·sec) of light. Line 40 represents the result obtained when a relatively large amount of light is used, and line 41 represents the result obtained when a relatively small amount of light is used. As is appreciated from FIG. 5, reduction in the potential after exposure decreases as the amount of light increases when the light amount for main exposure is kept constant.

The above-described results indicate that the sensitivity of the photosensitive layer 12 can be controlled by exposure with charging.

(Charge removing lamp driving circuit)

Returning to FIG. 1 again, the charge removing lamp 20 is connected to a charge removing lamp driving circuit 24. The charge removing lamp driving circuit 24 is connected to a power source 35 for supplying a power for turning on the charge removing lamp 20. The charge removing lamp driving circuit 24 is also connected to a light amount setting device 34. The charge removing lamp driving circuit 24 sets the amount of light radiated by the charge removing lamp 20 for charge removal at a prescribed level. The light amount setting device 34 sends a light amount control signal to the charge removing lamp driving circuit 24, thereby setting the amount of light radiated by the charge removing lamp 20 toward an area of the photosensitive layer 12 immediately below the main charger 14 at a prescribed level. The charge removing lamp driving circuit 24 drives the charge removing lamp 20 to radiate a prescribed amount of light at prescribed timing, based on prescribed data on the light amount for charge removal or data on the light amount for the light amount setting device 34 which is set as is described later. When the image forming apparatus 11 is produced, the amount of light radiated by the charge removing lamp 20 for exposure with charging is set at reference light amount E1. At this point, the sensitivity of the photosensitive layer 12 is S1, which is the reference sensitivity corresponding to reference light amount E1.

(Light amount setting circuit)

In the case when the light removing lamp 20 is driven by pulse-like signals, the light amount setting device 34 sends a signal to the charge removing lamp driving circuit 24. The signal is for adjusting the duty of a pulse-like driving signal supplied to the charge removing lamp 20 by the charge removing lamp driving circuit 24. The amount of light radiated by the charge removing lamp 20 is adjusted by the duty. In the case when the charge removing lamp 20 is driven by application of an AC voltage or a DC voltage, the light amount setting device 34 sends a signal to the charge removing lamp driving circuit 24. The signal is for adjusting the driving voltage supplied to the charge removing lamp 20 by the charge removing lamp driving circuit 24. The amount of light is adjusted by the driving voltage.

In the image forming apparatus 11, the amount of light radiated by the charge removing lamp 20 for exposure with charging is set in the light amount setting device 34. A type of surface potential of the photosensitive layer 12, for example, the charging potential or the potential after exposure of the photosensitive layer 12 is detected, and such a detected potential is set as a prescribed reference surface potential. For example, reduction in the potential required for equalizing the potential after exposure with the prescribed reference surface potential is calculated. The amount of light radiated by the charge removing lamp 20 required for performing such reduction is obtained from the relationship between the amount of light radiated toward an area of the photosensitive layer 12 immediately below the main charger 14 and the reduction in the potential at the developing position shown in FIG. 1. Thus, the amount of light radiated by the charge removing lamp 20 for exposure with charging is set in the light amount setting device 34.

(Adjustment device)

In order to adjust the amount of light radiated by the charge removing lamp 20 for exposure with charging, an adjustment device 33 shown in FIG. 1 is used. The adjustment device 33 includes a change detection device 26, a comparison circuit 27, a control device 28, a memory 29 and an output device 36. If the charge removing lamp driving circuit 24 has a function of storing a control signal which is set by the light amount setting device 34, the light amount setting device 34 may be included in the adjustment device 33.

The change detection device 26 is located in the vicinity of the photosensitive drum 13 and upstream with respect to the developing device 16 in a rotation direction of the photosensitive drum 13. The change detection device 26 detects at least one of the charging potential and the surface potential after exposure of the photosensitive layer 12. As the change detection device 26, for example, a potential sensor for detecting the surface potential of the photosensitive layer 12 may be used. In this example, such a potential sensor 31 is used as an example of the change detection device 26. The potential sensor 31 detects the potential and outputs a signal corresponding to the potential to the comparison circuit 27. The comparison circuit 27, which is controlled by the control circuit 28 connected thereto, compares the potential detected by the potential sensor 31 and a prescribed reference surface potential stored in the memory 29. Then, a change amount signal ΔSP corresponding to the difference between the detected potential and the reference surface potential is sent from the comparison circuit 27 to the control device 28. Such a difference indicates a change amount in the sensitivity of the photosensitive layer 12. The control device 28 outputs data for compensating for a difference in the amount of light radiated by the charge removing lamp 20 for exposure with charging, based on the change amount signal ΔSP. Hereinafter, such data will be referred to as "compensation data". The compensation data is sent from the control device 28 to the output device 36 such as a display apparatus or a printing apparatus and thus is visualized. The data thus visualized is used by the operator to input the compensation data to the light amount setting device 34. The light amount setting device 34 controls the charge removing lamp driving circuit 24 in accordance with the compensation data.

The reference surface potential stored in the memory 29 may be, for example, the charging potential or the potential after exposure of the photosensitive layer 12. The reference surface potential can be set at a certain level regardless of the material of the photosensitive layer 12, for example, whether the material is inorganic or organic.

Figure 6:
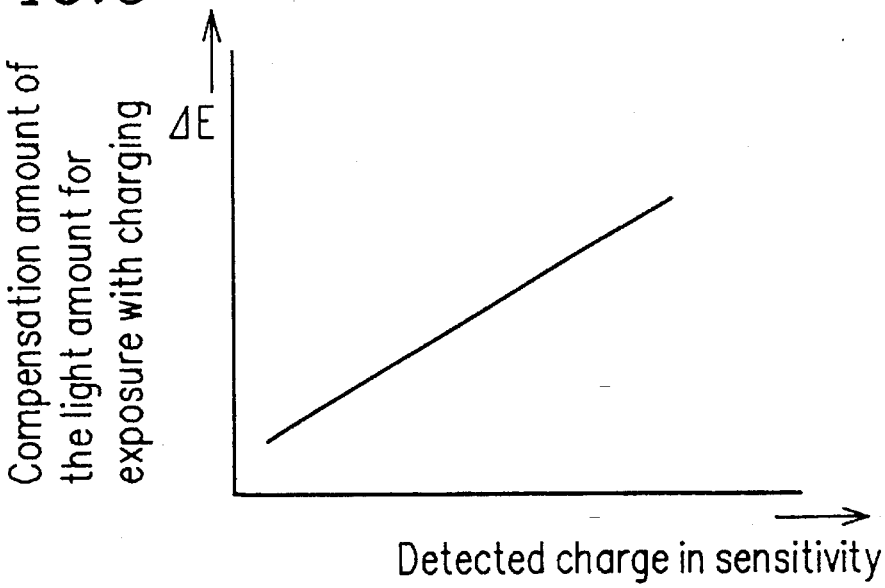
FIG. 6 is a graph illustrating compensation data stored in a memory.

FIG. 6 illustrates an example of the compensation data. In detail, FIG. 6 illustrates the compensation amount for the amount of light used for exposure with charging in relation to the detected change amount in the sensitivity. As is described above, the detected change amount in the sensitivity represents the difference between the potential detected by the potential sensor 31 and the reference surface potential. As is appreciated from FIG. 6, the compensation amount for the amount of light used for exposure with charging increases as the detected change amount in the sensitivity increases. In the image forming apparatus 11, the compensation amounts based on the detected surface potential may take values varying continuously or three or more values varying discontinuously. Such compensation amounts are determined as is described below.

From FIG. 5, the potential after exposure H is expressed by the function $H=f(R, E)$, where variable E is the amount of light used for exposure with charging and variable R is the amount of light used for main exposure. Since the sensitivity S is expressed by the function $S=g(B-H)$ from above, where B represents the reference surface potential, the sensitivity S can be converted into the function $S=h(R, E)$, where R and E are variables.

Figure 7:
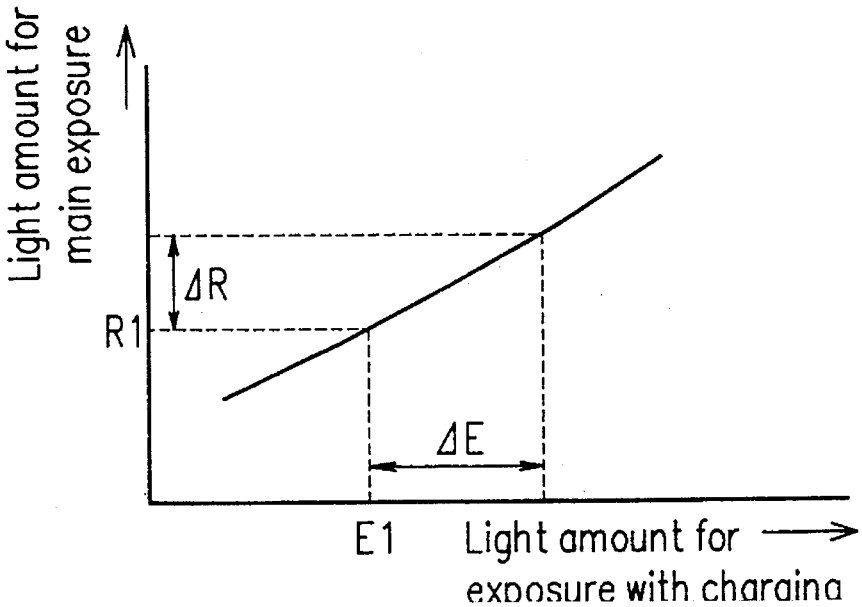
FIG. 7 is a graph illustrating the amount of light for main exposure in relation with the amount of light for exposure with charging, both required to reduce the surface potential of the photosensitive layer, e.g., from 800 V to 200 V.

FIG. 7 is a graph illustrating the amount of light for main exposure required for reducing the charging potential of the photosensitive layer 12 to the prescribed potential after exposure (for example, from 800 to 250 V), that is, the main exposure required for obtaining the prescribed reference sensitivity and the amount of light for exposure with charging. As is appreciated from FIG. 7, the light amount E for exposure with charging is in proportion to the light amount R for main exposure. This is expressed by the function R=f(E). Accordingly, when the light amount E is set at prescribed reference light amount E1, reference light amount R1 for main exposure is fixed in correspondence with E1. The image density of an image formed on the recording paper sheet 17 at this point is a reference image density.

When the light amount R for main exposure is fixed at a constant level, the sensitivity S changes only based on the light amount E for exposure with charging.

Thus, when the light amount R for main exposure is fixed at a constant level, a change amount ΔE in the light amount E corresponding to the change amount in the sensitivity S of the photosensitive layer 12 with respect to the reference sensitivity is inevitably determined. Accordingly, the compensation data for the light amount E for exposure with charging is obtained from the change amount in the sensitivity S with respect to the reference sensitivity as is shown in FIG. 6.

In this manner, the compensation data ΔE for the light amount E for exposure with charging is obtained. Based on the compensation data ΔE, the amount of light radiated by the charge removing lamp 20 is adjusted as is described above.

In the image forming apparatus 11, the difference in the sensitivity or the charging potential of the photosensitive layer 12 caused by different electric characteristics thereof among different production lots can be easily adjusted to be uniform. Thus, reduction in the image quality can be prevented with no troublesome adjustment.

(Device for performing exposure with charging)

As the charge removing lamp 20, a light source for visible light such as a halogen lamp, a fluorescent lamp, a cold CRT, a neon lamp for light of red, green and the like, or a single-color light source such as an LED (light emitting diode) for light of red, yellow, green and the like may be used.

Figure 8:
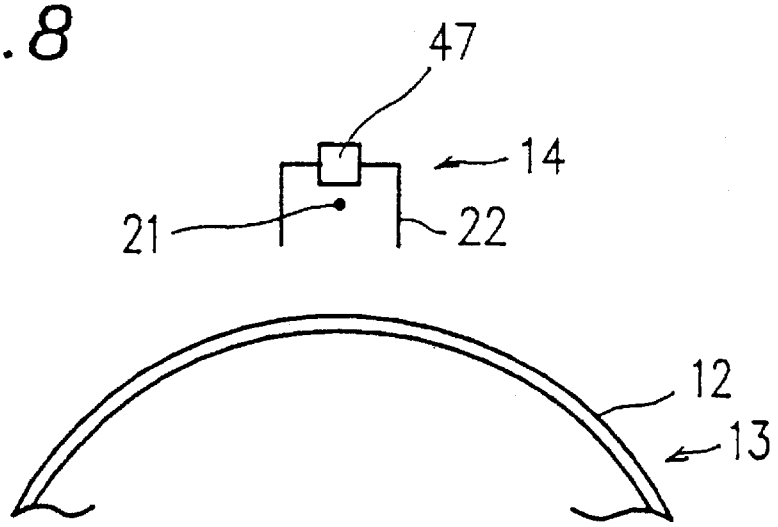
FIG. 8 is a schematic view of a device for adjusting the amount of light for exposure with charging.

Other devices may also be used for performing exposure with charging instead of the charge removing lamp 20. An example is shown in FIG. 8. In FIG. 8, a light source 47 such as an LED is located at an opening of the sealed case 22 of the main charger 14, the opening being opposite to the photosensitive layer 12. The light source 47 may be located on a side face of the sealed case 22. The light source 47 may be controlled in the same manner as the charge removing lamp 20 for the same effects.

The amount of light for exposure with charging is adjusted by controlling the amount of light radiated by the charge removing lamp 20 or the light source 47.

Figure 9:
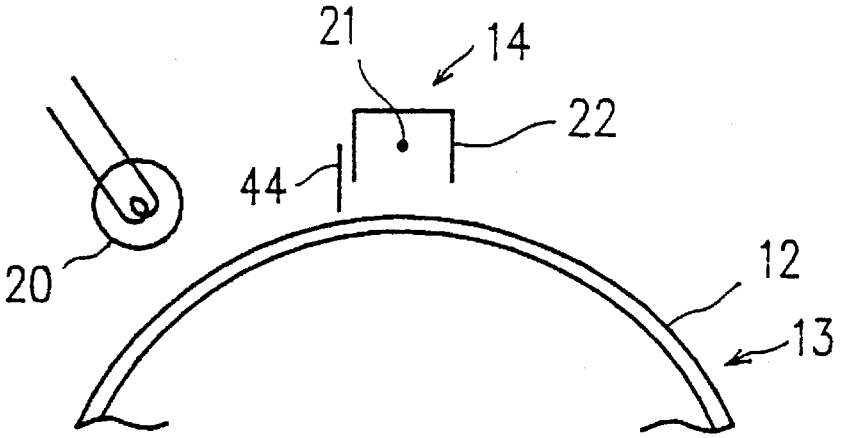
FIG. 9 is a schematic view of another device for adjusting the amount of light for exposure with charging.

FIG. 9 illustrates another method for adjusting the light amount for exposure with charging. In FIG. 9, a wall 44 is located outside a side face of the sealed case 22 of the main charger 14. The side face by which the wall 44 is located is closer to the charge removing lamp 20 than the other side face of the sealed case 22. The wall 44 is provided for adjusting the distance between the sealed case 22 and the photosensitive layer 12, thereby adjusting the amount of light radiated from the charge removing lamp 20 for exposure with charging. The wall 44 is formed of, for example, paper. The wall 44 is reciprocally movable upward and downward with respect to the surface of the photosensitive layer 12 and also can stop at an arbitrary position. By appropriately selecting the stopping position of the wall 44, the amount of light radiated to the charging area of the photosensitive layer 12 from the charge removing lamp 20 for exposure with charging can be adjusted. Accordingly, the amount of light radiated by the charge removing lamp 20 may be the same for charge removal, for exposure with charging, and for adjusting the light amount while exposure with charging.

According to still another method for adjusting the light amount for exposure with charging, a filter is provided between the charge removing lamp 20 or the light source 47 and the photosensitive layer 12, thereby adjusting the amount of light radiated toward a charging area of the photosensitive layer 12. As such a filter, an ND filter or a filter using a radical light emitting member is used, for example. The filter using a radical light emitting member operates in the following manner. A molecular structure contained in a material of the filter represented by structural formula 1 changes into structural formula 2 by corona discharge performed by the main charger 14 and ozone generated by the corona discharge and thus emits light.

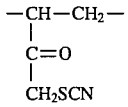

Structural formula 1

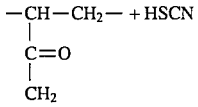

Structural formula 2

According to still another method for adjusting the light amount for exposure with charging, the ratio of a space of the grid 23 with respect to the total area thereof is changed. Since the level of the discharge current Ipc flowing from the main charger 14 to the photosensitive layer 12 changes in accordance with such a ratio, the same adjusting effect can be obtained.

(Main charger)

As the main charger, a scorotron charger is preferably used. By using a scorotron charger as the main charger 14, the surface potential of the photosensitive layer 12 of the photosensitive drum 13 at the charging position reaches and is maintained at a prescribed maximum limit for the following reason.

As is described above, the current Icc from the power source 25 flowing to the discharge wire 21 is branched into the discharge current Isc flowing to the shielding case 22, the discharge current Igc flowing to the grid 23, and the discharge current Ipc flowing to the photosensitive drum 13. When the surface potential of photosensitive layer 12 is lower than the potential of the grid 23, the discharge current Ipc from the discharge wire 21 reaches the surface of the photosensitive layer 12 through the grid 23. When the discharge current Ipc from the discharge wire 21 is supplied to the photosensitive layer 12, the surface potential of the photosensitive layer 12 gradually rises. When the surface potential of the photosensitive layer 12 becomes substantially equal to the potential of the grid 23, the current Icc supplied to the discharge wire 21 is branched substantially only to the discharge currents Isc and Igc. Accordingly, the surface potential of the photosensitive layer 12 is generally determined by the potential of the grid 23 and is maintained in the vicinity of the potential of the grid 23 after reaching the potential of the grid 23.

In the case when a scorotron charger is used as the main charger 14, it is preferable to charge the photosensitive layer 12 so that the saturated surface potential Vs of the photosensitive layer 12 will be in a range between about 500 V and about 1,000 V, preferably in a range between about 700 V and about 850 V. In order to perform such charging, it is preferable to apply a high voltage of about 4 to about 7 kV to the discharge wire 21 of the main charger 14 when performing corona discharge.

(Optical device)

As the optical device 15, an optical system including a lens, a reflective mirror and the like, a laser oscillator, or the like may be used.

(Charge removal)

Before charging the photosensitive layer 12, the surface potential of the photosensitive layer 12 is preferably about 100 V or less. Although the amount of light radiated by the charge removing lamp 20 required for realizing such a level of the surface potential depends on the type of the photosensitive layer 12, the illuminance on the photosensitive layer 12 is preferably about 5 lux·sec. to about 200 lux·sec., more preferably about 10 lux·sec. to about 100 lux·sec. If the illuminance exceeds about 200 lux·sec., the image quality deteriorates due to wearing of the photosensitive layer 12 caused by light.

(Photosensitive layer)

As the photosensitive layer 12, an inorganic photoconductive material, such as Se, or a single-layered or multiple-layered organic photoconductive material may be used.

A photosensitive layer formed of an organic material may be of a type to be positively charged or negatively charged. Preferably, a single-layer photosensitive layer of a type to be positively charged is used because of various advantages including very little ozone generation at the time of charging by the main charger 14.

The photosensitive layer 12 is formed by diffusing a charge carrying medium and a charge generating material into a binder resin.

As the charge generating material, any known organic photoconductive pigment may be used. For example, a phthalocyanine-type pigment, a perylene-type pigment, a quinacridone-type pigment, a pyranetron-type pigment, a bisazo-type pigment, or a trisazo-type pigment may be used independently or in combination of two or more. Especially, a perylene-type pigment, an azo-type pigment, or a combination thereof is preferable.

The charge carrying medium is formed by diffusing a charge carrying material in a resin.

As the charge carrying material, a known hole carrying material or a known electron carrying material may be used.

As the hole carrying material, poly-N-vinylcarbazole, phenanthrene, N-ethylcarbazole, 2,5-diphenyl-1,3,4-oxadiazole, 2,5-bis(4-diethylaminophenyl)-1,3,4-oxadiazole, bis-diethylaminophenyl-1,3,6-oxadiazole, 4,4'-bis(diethylamino)-2,2'-dimethyltriphenylmethane, 2,4,5-triaminophenylimidazole, 2,5-bis(4-diethylaminophenyl)-1,3,4-triazole, 1-phenyl-3 -(4-diethylaminostyril)-5-(4-diethylaminophenyl)-2-pyrazoline, p-diethylaminobenzaldehyde(diphenylhydrazone), or a mixture thereof may be used. Among these materials, a diphenoquinone derivative such as 2,6-dimethyl-2',6-di-tert-butyl-diphenoquinone, a diamine-type compound such as 3,3'-dimethyl-N,N,N',N'-tetrakis- 4-methylphenyl(1,1'-biphenyl)-4,4'-diamine, a fluorene-type compound, a hydrazone-type compound, or a mixture thereof is especially preferable.

As the electron carrying material, for example, 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxantone, dinitroanthracene, dinitroacridine, dinitroanthraquinone, or a mixture thereof may be used.

As the binder resin, for example, a styrene-type polymer, a styrene-butadiene copolymer, a styrene-acrylonitrile copolymer, a styrene-maleic acid copolymer, an acrylic polymer, a styrene-acrylic copolymer, a styrene-vinyl acetate copolymer, a poly(vinyl chloride), a vinyl chloride-vinyl acetate copolymer, polyester, an alkyd resin, polyamide, polyurethane, an epoxy resin, polycarbonate, polyallylate, polysulfone, a diallylphthalate resin, a silicone resin, a ketone resin, a polyvinylbutyral resin, a polyether resin, a phenol resin; a photocurable resin such as epoxy acrylate or urethane acrylate; or a mixture thereof may be used. A photoconductive polymer such as poly-N-vinylcarbazole may also be used.

The amount of the charge generating material contained in the photosensitive layer 12 is preferably about 0.1 to about 50 parts, more preferably about 0.5 to about 30 parts with respect to 100 parts of the binder resin. The amount of the charge carrying material contained in the photosensitive layer 12 is preferably about 20 to about 500 parts, more preferably about 30 to about 200 parts with respect to 100 parts of the bonding resin. The photosensitive layer 12 preferably has a thickness of about 10 to about 40 μm, more preferably of about 22 to about 32 μm in order to obtain a sufficiently high surface potential, a sufficiently high durability against repeated image forming, and a sufficiently high sensitivity.

The drum substrate 30 is generally formed of a plain aluminum tube or an aluminum tube with an alumetized surface. Any conductive material may be used. For example, metal, a conductive resin, or a conductive film is used. The substrate may be provided in the form of a belt instead of a drum.

The photosensitive layer 12 is formed in the following manner.

The binder resin is dissolved in a solvent, and the charge generating material is diffused in the dissolved bonding resin to prepare a composition. The composition is applied to the surface of the drum substrate 30. As the solvent, for example, an amide-type solvent such as N,N-dimethylformamide or N,N-dimethylacetoamide; a cyclic ether such as tetrahydrofuran or dioxan; dimethylsulfoxide; an aromatic solvent such as benzene, toluene, or xylene; ketone such as methylethylketone; N-methyl-2-pyrrolidone; or phenol such as phenol or cresol may be used.

EXAMPLE 2

Figure 10:
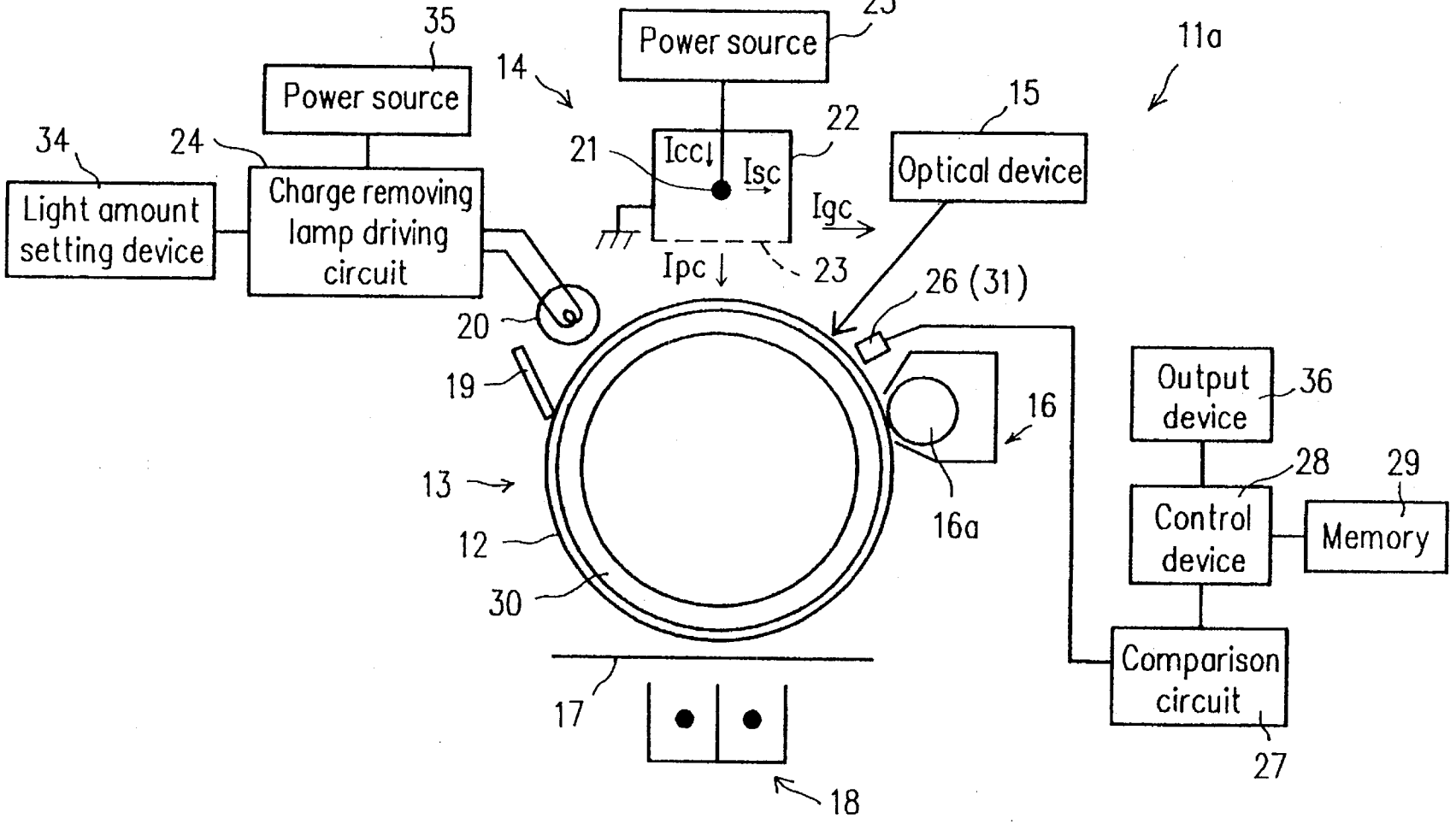
FIG. 10 is a schematic view of an image forming apparatus in a second example according to the present invention.

FIG. 10 is a schematic view of an image forming apparatus **11*a* in a second example according to the present invention. Same elements as those in the image forming apparatus 11** in the first example bear the same reference numerals therewith.

In the second example, the potential sensor 31, the comparison circuit 27, the control device 28 and the memory 29 are directly incorporated into the image forming apparatus **11*a* instead of being included in the adjustment device 33. In this structure, the compensation data for the light amount setting device 34 is automatically set by the control device 28. Due to such automatic setting, even if at least one of the sensitivity and the charging potential of the photosensitive layer 12 reduces by repeated use, reduction in the sensitivity or the charging potential is automatically compensated for in the same manner as is described regarding the image forming apparatus 11. Such compensation is performed when the image forming apparatus 11*a*** is turned on, when reduction in the sensitivity or the charging potential by a prescribed level is detected, or when a prescribed number of copies are made. The compensation may be performed at two or more such occasions.

Figure 11:
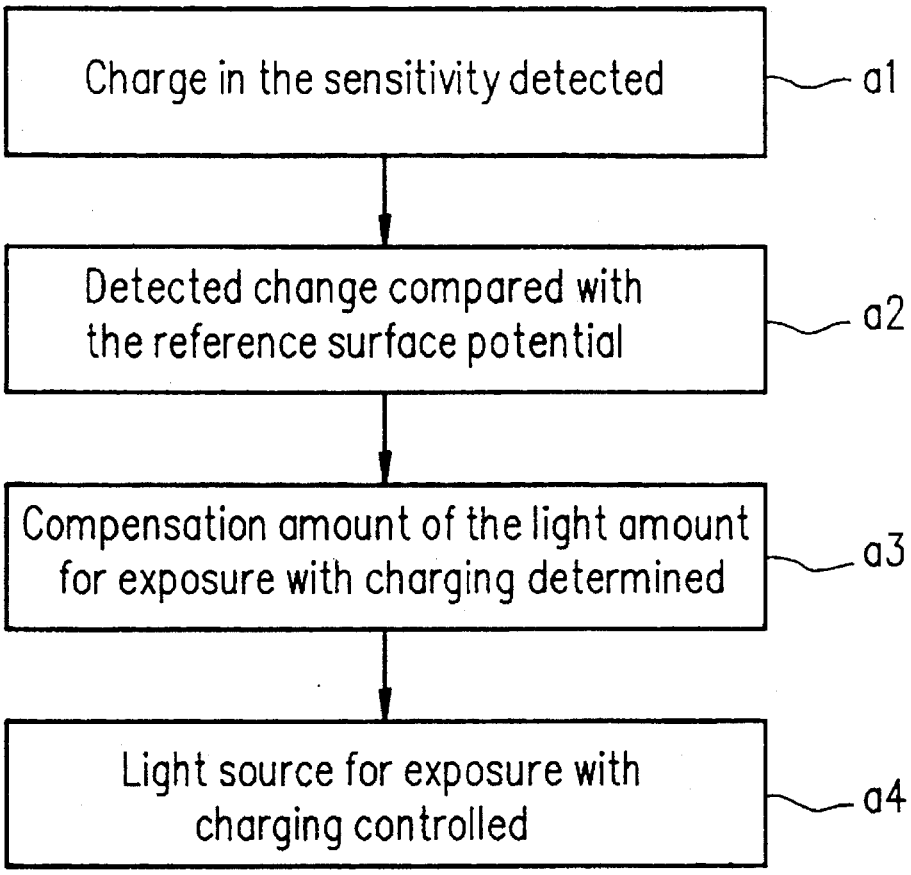
FIG. 11 is a flowchart illustrating the compensation operation of the image forming apparatus shown in FIG. 10.

FIG. 11 is a flowchart illustrating the compensation operation of the image forming apparatus **11*a***.

In step a1, the surface potential of the photosensitive layer 12 is detected by the potential sensor 31. In step a2, the surface potential detected in step S1 is compared with the reference surface potential by the comparison circuit 27, the control device 28 and the memory 29 as is described regarding the image forming apparatus 11, and is applied to the data stored in the memory 29 as is shown in FIG. 6. In step a3, the compensation amount for the light amount for exposure with charging is determined from such data. In step a4, the light amount setting device 34 is controlled by the control device 28, thereby adjusting the light amount for exposure with charging.

In the image forming apparatus 11*a*, a separate adjustment device which is required for the image forming apparatus 11 in order to compensate for at least one of the sensitivity and the charging potential of the photosensitive layer 12 during production thereof is not necessary. Such a compensation operation during the production is performed by the potential sensor 31, the control device 28, and the light amount setting device 34 in the image forming apparatus 11*a*. Furthermore, such a compensation operation required by repeated use can be performed with no special operation using an external device.

In this manner, non-uniformity in the image density caused by non-uniform electric characteristics among different production lots is prevented by the automatic adjustment performed during production. Furthermore, reduction in the sensitivity and the charging potential of the photosensitive layer 12 caused by repeated use is prevented. Such adjustment can be performed without using a mechanism for adjusting the light amount from the optical device 15, and thus an image forming apparatus having a simpler structure and a smaller size can be realized.

EXAMPLE 3

Figure 12:
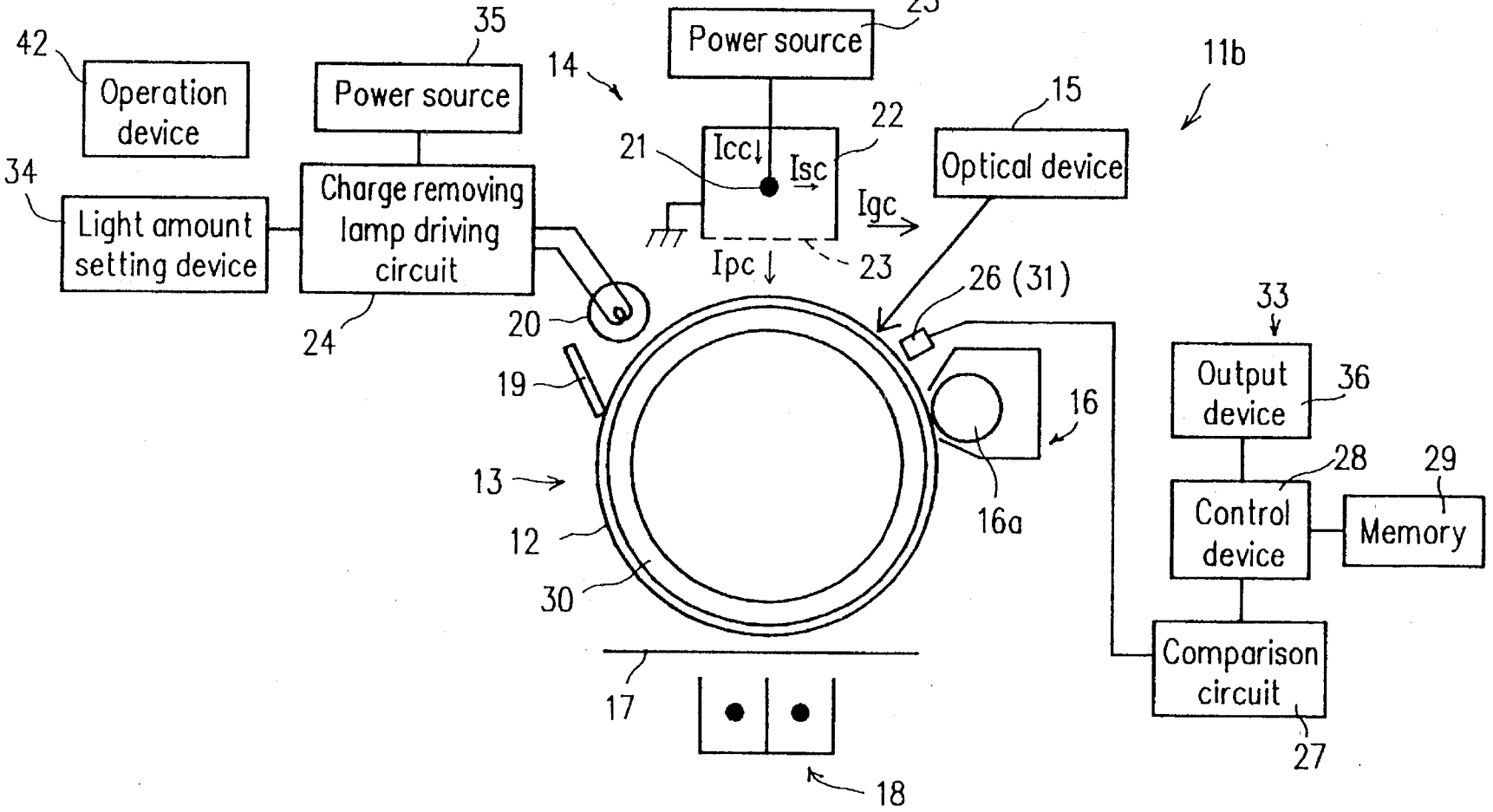
FIG. 12 is a schematic view of an image forming apparatus in a third example according to the present invention.

FIG. 12 is a schematic view of an image forming apparatus 11*b* in a third example according to the present invention. The same elements as those in the image forming apparatus 11 bear the same reference numerals therewith.

The image forming apparatus 11*b* includes an operation device 42 connected to the light amount setting device 34. The operation device 42 receives an external input of a signal.

Figure 13:
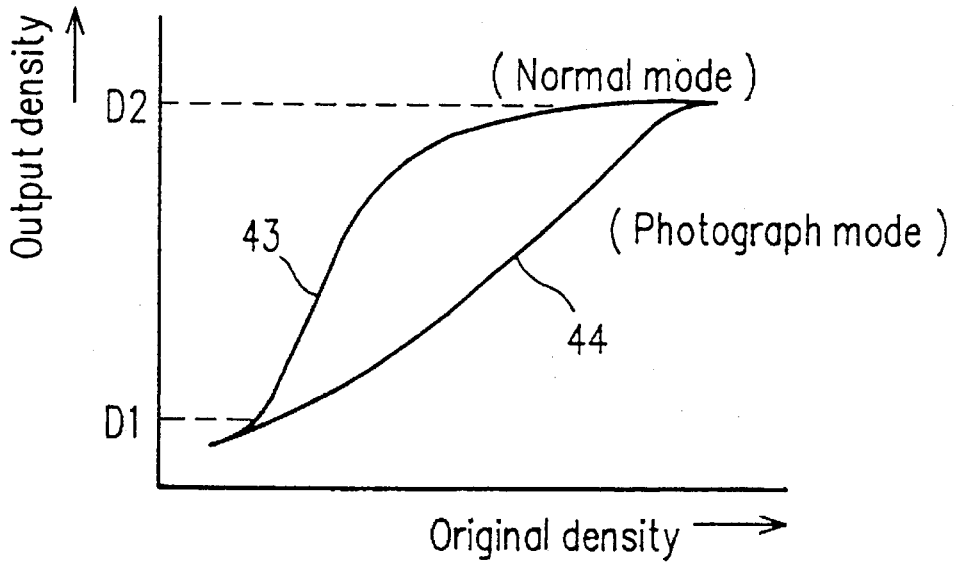
FIG. 13 is a graph illustrating the relationship between the density of an image formed on a recording paper sheet obtained by the image forming apparatus shown in FIG. 12 and the density of an original document.

FIG. 13 is a graph illustrating the relationship between the image density of an original document (hereinafter, referred to as an "original density") and the density of an image formed on the recording paper sheet 17 (hereinafter, referred to as an "output density"). Line 43 represents such a relationship when the amount of light radiated to the photosensitive layer 12 for exposure with charging is relatively small; and line 44 represents such a relationship when such a light amount is relatively large.

As is shown by line 43, when the light amount is relatively small, the output density rises drastically with respect to a change in the original density; in other words, the gamma characteristic is high. In an area where the original density is equal to or lower than a prescribed level, the output density can be set at first density D1 corresponding to a white area (non-image area) of the document. In an area where the original density is higher than a prescribed level, the output density can be set at second density D2 corresponding to an image area of the document. Such relationship between the original density and the output density is appropriate to the formation of a black and white image having no intermediate tones. As is shown by line 44, when the light amount is relatively large, the change in the output density with respect to the change in the original density is slower than in the case of line 43; in other words, the gamma characteristic is lower. In this case, for example, the change in the output density linearly corresponds to the change in the original density. Such relationship between the original density and the output density is appropriate to an image having various tones such as a photograph.

Figure 14:
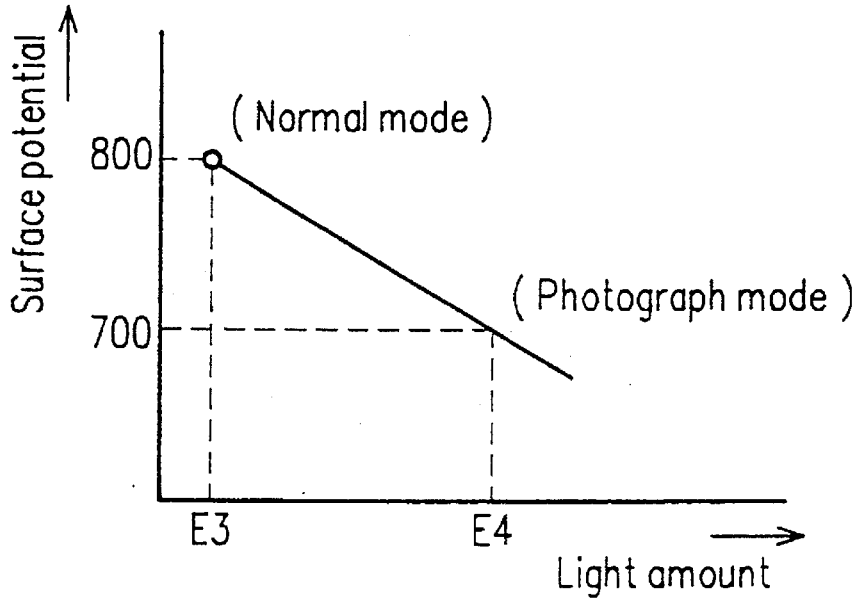
FIG. 14 is a graph illustrating the surface potential of the photosensitive layer in relation with the amount of light for exposure with charging in the image forming apparatus shown in FIG. 12.
Figure 15:
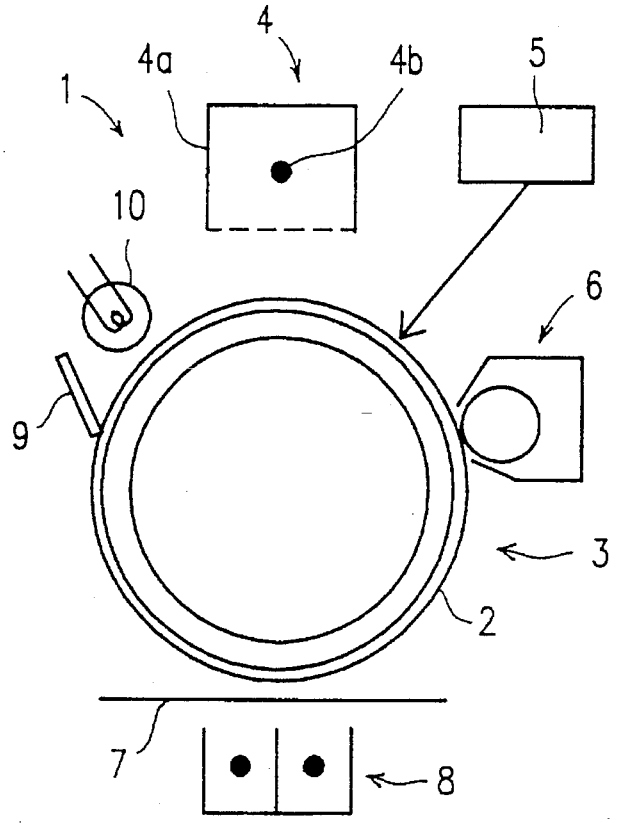
FIG.15 PRIOR ART
FIG. 15 is a schematic view of a conventional image forming apparatus using an electrophotographic technology.
Figure 16:
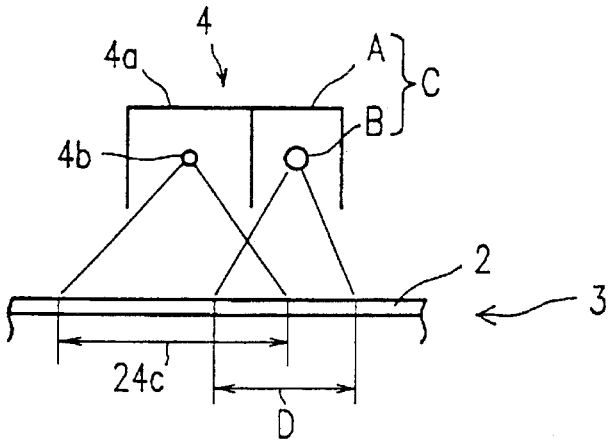
FIG.16 PRIOR ART
FIG. 16 is a schematic cross sectional view of a device conventionally used for compensating for non-uniformity in the sensitivity of a photosensitive layer.
Figure 17:
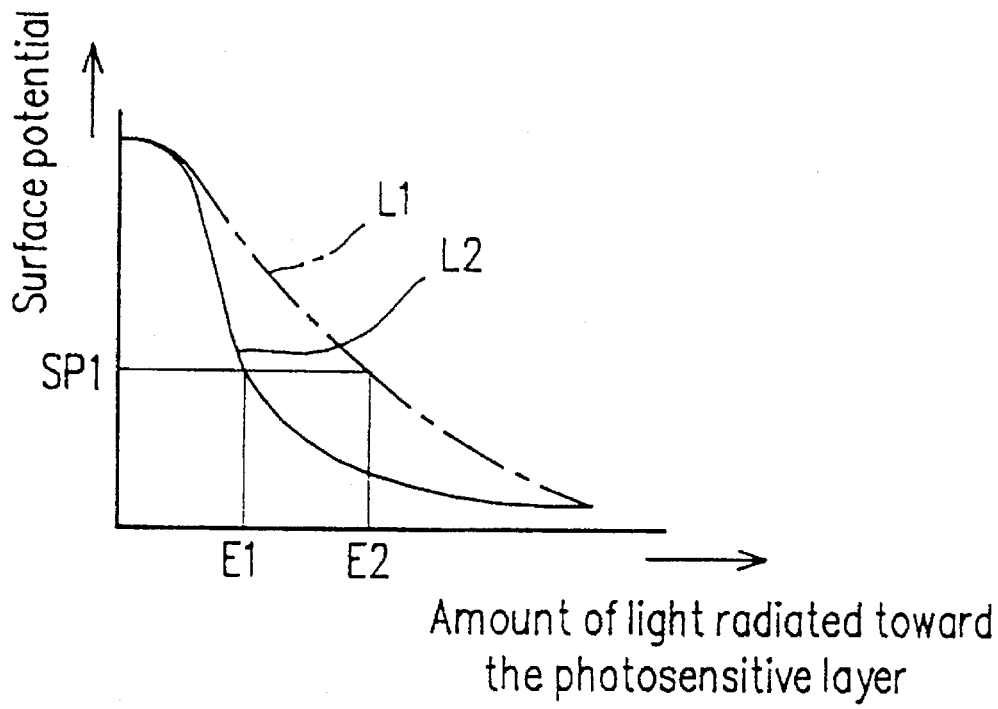
FIG. 17 is a graph illustrating the amount of light radiated to the photosensitive layer in the state of being charged and the surface potential thereof in the case where the photosensitive layer is formed of an organic material and an inorganic material.

Thus, in the image forming apparatus 11*b*, either one of a photograph mode for forming an image having various tones and a normal mode for forming an image without various tones can be selected by adjusting the light amount for exposure with charging. FIG. 14 is a graph illustrating the amount of light for exposure with charging and the surface potential of the photosensitive layer 12. The light amount for exposure with charging based on the surface potential of the photosensitive layer 12 detected by the potential sensor 31 is set at E3 or E4. E3 and E4 are set so that, for example, the surface potential of the photosensitive layer 12 obtained by charging will be 800 V at the smaller light amount E3 and 700 V at the larger light amount E4. The smaller light amount E3 is used for setting the normal mode, and the larger light amount E4 is used for setting the photograph mode. The compensation data for the light amount for exposure with charging shown in FIG. 6 is stored in the memory 29, and such compensation data as to set the light amount for exposure with charging at E3 or E4 is selected by the operation device 42.

In the image forming apparatus 11*b*, the same effects as described above regarding the image forming apparatuses 11 and 11*a* are obtained by the operation device 42. Furthermore, the photograph mode which is appropriate for an image having various tones and the normal mode which is appropriate for an image without various tones can be selected.

EXPERIMENTS

<Experiment 1 using the image forming apparatus 11 in the first example>

A single-layer photosensitive drum was produced under the following conditions.

(Production of a single-layer electrophotographic photosensitive drum)

A material having the following composition was diffused and mixed by a paint shaker for two hours to prepare a liquid for the single-layer photosensitive layer. The liquid was applied to a surface of an aluminum drum having an outer diameter of 30 mm. The drum was dried at a temperature of 110° C. for 30 minutes to form a single-layer photosensitive layer having a thickness of 30 μm. In this manner, the electrophotographic photosensitive drum of a type to be positively charged was obtained.

| Composition (parts by weight) | |
|---|---|
| Bisazo pigment having the following formula | 10 |

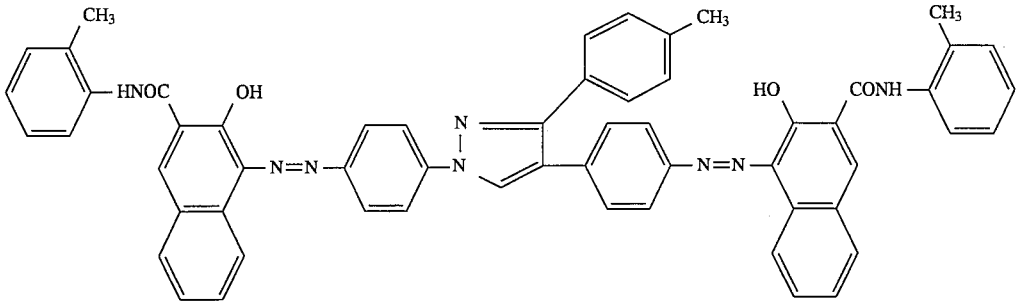

| | |
|---|---|
| 3,3'-dimethyl-N,N,N',N'-tetrakis-4-methylphenyl(1,1'-biphenyl)-4,4'-diamine | 100 |
| 3,3'-dimethyl-5,5'-ditert-butyl-4,4'-diphenoquinone | 50 |
| Polycarbonate resin | 150 |

(Experiment)

The following photosensitive drums were each mounted on the image forming apparatus 11 shown in FIG. 1 (modified from DC-2556 produced by Mira Industrial Co,. Ltd. for use in the experiment), and the surface potential of the photosensitive drum was adjusted to be 800±20 V by the main charger 14.

Photosensitive drum 1: produced in the above-described manner.

Photosensitive drum 2: produced in the above-described manner; having a different sensitivity from that of photosensitive drum 1.

Photosensitive drum 3: obtained by performing a running test (30,000 times) of photosensitive drum 2.

Photosensitive drum 4: obtained by performing a running test (80,000 times) of photosensitive drum 2.

Photosensitive drum 5: obtained by performing a running test (120,000 times) of photosensitive drum 2.

Then, the light amount required for setting the surface potential after exposure at approximately 250 V was measured. The results are shown in Table 2. The photosensitive drums all had different sensitivities.

Next, while maintaining the charging conditions for setting the surface potential at 800±20 V, each photosensitive drum was irradiated at an illuminance of 3.5 lux·sec., and the potential after exposure was measured. The results are also shown in Table 2. The photosensitive drums had different potentials after exposure due to the different sensitivities.

The amount of light radiated toward the charging area was controlled to examine the change in the potential after exposure. The results are shown in Table 2. Since the image forming apparatus used for the experiment has a scorotron charger as the main charger 14, the surface potential can be 800±20 V even if light is radiated toward the charging area.

The results shown in Table 2 indicate that the potential after exposure can be adjusted at around 250 V by controlling the light amount for exposure with charging in photosensitive drums 1 through 5.

As is appreciated from the results of the experiment, the same potential after exposure can be obtained, namely, the sensitivity can be compensated for by radiating a prescribed amount of light toward the charging area even if the sensitivity of the photosensitive layer 12 is different.

TABLE 2

| *1Controlling the sensitivity by light radiation toward the charging area of the photosensitive layer | | | |
|---|---|---|---|
| *2Sensitivity of the photosensitive drum before compensation | | | |
| *3Required light amount 800 V→250 V (lux · sec) | *4Potential after exposure 4 lux · sec (V) | *5Light amount for compensation of the sensitivity (mV · sec) | *6Potential after exposure after compensation (V) |
| 2.5 | 160 | 3.2 | 252 |
| 3.5 | 195 | 1.8 | 253 |
| 3.8 | 210 | 1.5 | 248 |
| 4.0 | 225 | 1.0 | 253 |
| 4.5 | 250 | 0 | 250 |

*1: DC-2556 produced by Mita Industrial Co., Ltd. was modified for the experiment to have a circumferential speed of 300 mm/sec. The initial surface potential was set at 800 ± 20 V.

*2: Sensitivity of the photosensitive drum when no light is radiated to the charging area.

*3: Amount of light radiated by the optical device 15 which is required to set the potential after exposure at 250 V.

*4: Potential after exposure when the illuminance of the surface of the photosensitive drum irradiated by light from the optical device 15 is 4 lux · sec.

*5: Amount of light radiated toward the charging area when the potential after exposure is adjusted to be 250 V (As the photosensor for detecting the amount of light radiated toward an area of the photosensitive layer 12 immediately below the main charger 14, S1226-BK produced by Hamamatsu Photonics, Inc. was used. The light amount is represented by the value obtained by converting the current detected by the photosensor (photodiode) to the voltage and integrating the voltage by the tim e period in which the light was radiated.)

<Experiment 2 using the image forming apparatus 11*a* in the second example>

By the following experiment, it has been found out that the charge level on the surface of the photosensitive layer 12 can be changed in accordance with the original density by changing the amount of light radiated for exposure with charging to the same photosensitive layer as in experiment 1. In other words, the following experiment is for examining the change in the E-V characteristic. The experiment was performed in the following manner.

A specific photosensitive drum which requires an illuminance of 3.5 lux·sec. to attenuate the surface potential from 800 V to 250 V with no light radiation to the charging area was mounted on the image forming apparatus 11*a* shown in FIG. 10.

Next, the charging conditions were set so that the surface of the photosensitive drum would be 800 V. After the illuminance for exposing the image on the photosensitive drum is set at 3.5 lux·sec., the light amount for exposure with charging was variously changed to measure the surface potential after charging and the potential after exposure in the developing position. The results are shown in Table 3.

TABLE 3

| | Light amount for exposure with charging (lux · sec) | Dark potential (V) | Potential after exposure (V) |
|---|---|---|---|
| Condition 1 | 0 | 800 | 250 |
| Condition 2 | 2.5 | 780 | 260 |
| Condition 3 | 4.0 | 770 | 265 |
| Condition 4 | 4.5 | 760 | 270 |
| Condition 5 | 5.5 | 750 | 275 |

The results shown in Table 3 indicate that the surface potential after charging and the potential after exposure can be controlled by changing the amount of light radiated to the charging area.

After the light amount for exposure with charging was set at each of the above-described conditions, the voltage to be applied for charging was adjusted so that the surface potential of the photosensitive drum corresponding to value N of a Munsell gray scale of 8.0 (the surface potential obtained by exposing the photosensitive layer 12 in each of the above-mentioned conditions when the Munsell gray scale is used as the document) would be 250 V. Then, the potential after exposure corresponding to the Munsell gray scale with respect to various light amounts was measured. The results are shown in Table 4.

TABLE 4

| | Light amount for exposure | Dark potential | Potential after exposure corresponding to Munsell gray scale (V) | | | |
|---|---|---|---|---|---|---|
| | (lux · sec) | (V) | N = 1.0 | N = 6.0 | N = 8.0 | N = 9.5 |
| Condition 6 | 0 | 800 | 750 | 430 | 250 | 160 |
| Condition 7 | 2.5 | 810 | 765 | 450 | 250 | 165 |
| Condition 8 | 4.0 | 825 | 770 | 480 | 250 | 170 |
| Condition 9 | 4.5 | 730 | 680 | 400 | 250 | 160 |
| Condition 10 | 5.5 | 750 | 700 | 410 | 250 | 165 |

The results shown in Table 4 indicate that the E-V characteristic, namely, the tone reproducibility can be adjusted arbitrarily.

<Experiment 3 using the image forming apparatus 11*b* in the third example>

Image forming was performed using two-component developers. Condition 6 in Table 4 was used for the normal mode, and condition 10 was used for the photograph mode. Table 5 shows the density of an image formed as a duplicate in conditions 6 and 10. As is appreciated from Table 5, a clear image having a high contrast was obtained in the normal mode, and an image having excellent tone reproducibility was obtained in the photograph mode.

TABLE 5

| | Exposure with charging (lux · sec) | Density of an image for Munsell gray scale | | | |
|---|---|---|---|---|---|
| | | N = 1.0 | N = 6.0 | N = 8.0 | N = 9.5 |
| Condition 6 | 0 | 1.400 | 0.950 | 0.093 | 0.088 |
| Condition 10 | 5.5 | 1.350 | 0.750 | 0.092 | 0.087 |

In an image forming apparatus according to the present invention, when the photosensitive layer of the photosensitive drum is being charged by the main charger or after the photosensitive layer is charged, light is radiated to a charging area of the photosensitive layer by a light radiation device which can adjust the light amount. By such light radiation, the following effects, for example, can be achieved.

(1) Non-uniformity in the sensitivity and the charging potential of the photosensitive layer can be compensated for.

(2) Different levels of reproducibility can be obtained from one original document by controlling the charging potential while radiating the light, without exchanging photosensitive members.

(3) The normal mode for forming an image at a normal tone reproducibility or the photograph mode for forming an image at a higher tone reproducibility can be selected by setting two values of reproducibility in advance even if one photosensitive member is used.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image forming apparatus, comprising:

a rotatable photosensitive member including a conductive base and a photosensitive layer located on a surface of the base;

charging means located in the vicinity of the photosensitive member for charging the photosensitive layer;

charge removing means located upstream with respect to the charging means in a rotation direction of the photosensitive member for radiating light toward the photosensitive layer prior to charging performed by the charging means to uniformize a surface potential of the photosensitive layer;

light radiation means for radiating light to a charging area of the photosensitive layer in the state of being charged by the charging means and for adjusting the amount of the light to be radiated;

exposing means for radiating light corresponding to an image toward the photosensitive layer in the state of being charged;

developing means located downstream with respect to the exposing means in the rotation direction of the photosensitive member;

change detection means for detecting a change in at least one of a charging potential of the photosensitive layer and a sensitivity of the photosensitive layer; and compensation means for compensating for the change by adjusting the amount of the light radiated toward the charging area by the light radiation means based on results obtained by the change detection means, wherein the light radiation means includes light emitting means which is different from the charge removing means, the charging means includes a discharge member for performing discharge toward the photosensitive layer and a first case surrounding the discharge member and opened toward the photosensitive layer, the light radiation means includes a light emitting member and a second case surrounding the light emitting member and opened toward the charging area of the photosensitive layer, and the first case and the second case have a common part.

2. An image forming apparatus according to claim 1, wherein the light radiation means generates light as pulses.

3. An image forming apparatus according to claim 1, wherein the compensation means includes light emission driving means for driving the light radiation means and light amount setting means for setting the amount of light radiated by the light radiation means.

4. An image forming apparatus, comprising:

a rotatable photosensitive member including a conductive base and a photosensitive layer located on a surface of the base;

charging means located in the vicinity of the photosensitive member for charging the photosensitive layer;

charge removing means located upstream with respect to the charging means in a rotation direction of the photosensitive member for radiating light toward the photosensitive layer prior to charging performed by the charging means to uniformize a surface potential of the photosensitive layer;

light radiation means for radiating light to a charging area of the photosensitive layer in the state of being charged by the charging means and for adjusting the amount of the light to be radiated;

exposing means for radiating light corresponding to an image toward the photosensitive layer in the state of being charged;

developing means located downstream with respect to the exposing means in the rotation direction of the photosensitive member;

operation means for outputting an adjusting signal for setting at least one of a charging potential of the photosensitive layer and a sensitivity of the photosensitive layer at one of a plurality of different values determined in advance; and compensation means for setting at least one of the charging potential of the photosensitive layer and the sensitivity of the photosensitive layer at the one of the plurality of different values determined in advance by adjusting the amount of light radiated toward the charging area by the light radiation means based on the adjusting signal, wherein the charge removing means acts as the light radiation means.

5. An image forming apparatus according to claim 4, wherein the light radiation means generates light as pulses.

6. An image forming apparatus according to claim 4, wherein the compensation means includes light emission driving means for driving the light radiation means and light amount setting means for setting the amount of light radiated by the light radiation means.

7. An image forming apparatus, comprising:

a rotatable photosensitive member including a conductive base and a photosensitive layer located on a surface of the base;

charging means located in the vicinity of the photosensitive member for charging the photosensitive layer;

charge removing means located upstream with respect to the charging means in a rotation direction of the photosensitive member for radiating light toward the photosensitive layer prior to charging performed by the charging means to uniformize a surface potential of the photosensitive layer;

light radiation means for radiating light to a charging area of the photosensitive layer in the state of being charged by the charging means and for adjusting the amount of the light to be radiated;

exposing means for radiating light corresponding to an image toward the photosensitive layer in the state of being charged;

developing means located downstream with respect to the exposing means in the rotation direction of the photosensitive member;

operation means for outputting an adjusting signal for setting at least one of a charging potential of the photosensitive layer and a sensitivity of the photosensitive layer at one of at least two different values determined in advance; and compensation means for setting at least one of the charging potential of the photosensitive layer and the sensitivity of the photosensitive layer at the one of the at least two different values by adjusting the amount of light radiated toward the charging area by the light radiation means based on the adjusting signal, at least one of the at least two different values determined in advance being selected so as to change a gamma characteristic of the photosensitive layer with respect to the image, wherein the charge removing means acts as the light radiation means.

8. An image forming apparatus according to claim 7, wherein the sensitivity of the photosensitive layer is set at two different values by the compensation means.

9. An image forming apparatus according to claim 7, wherein the sensitivity of the photosensitive layer set by the compensation means is selected from at least three different values.

10. An image forming apparatus according to claim 7, wherein the light radiation means generates light as pulses.

11. An image forming apparatus according to claim 7, wherein the compensation means includes light emission driving means for driving the light radiation means and light amount setting means for setting the amount of light radiated by the light radiation means.

12. An image forming apparatus, comprising:

a rotatable photosensitive member including a conductive base and a photosensitive layer located on a surface of the base;

charging means located in the vicinity of the photosensitive member for charging the photosensitive layer;

charge removing means located upstream with respect to the charging means in a rotation direction of the photosensitive member for radiating light toward the photosensitive layer prior to charging performed by the charging means to uniformize a surface potential of the photosensitive layer;

light radiation means for radiating light to a charging area of the photosensitive layer in the state of being charged by the charging means and for adjusting the amount of the light to be radiated;

exposing means for radiating light corresponding to an image toward the photosensitive layer in the state of being charged;

developing means located downstream with respect to the exposing means in the rotation direction of the photosensitive member;

operation means for outputting an adjusting signal for setting at least one of a charging potential of the photosensitive layer and a sensitivity of the photosensitive layer at one of a plurality of different values determined in advance; and compensation means for setting at least one of the charging potential of the photosensitive layer and the sensitivity of the photosensitive layer at the one of the plurality of different values determined in advance by adjusting the amount of light radiated toward the charging area by the light radiation means based on the adjusting signal, wherein the light radiation means includes light emitting means which is different from the charge removing means, the charging means includes a discharge member for performing discharge toward the photosensitive layer and a first case surrounding the discharge member and opened toward the photosensitive layer, the light radiation means includes a light emitting member and a second case surrounding the light emitting member and opened toward the charging area of the photosensitive layer, and the first case and the second case have a common part.

13. An image forming apparatus according to claim 12, wherein the light radiation means generates light as pulses.

14. An image forming apparatus according to claim 12, wherein the compensation means includes light emission driving means for driving the light radiation means and light amount setting means for setting the amount of light radiated by the light radiation means.

15. An image forming apparatus, comprising:

a rotatable photosensitive member including a conductive base and a photosensitive layer located on a surface of the base;

charging means located in the vicinity of the photosensitive member for charging the photosensitive layer;

charge removing means located upstream with respect to the charging means in a rotation direction of the photosensitive member for radiating light toward the photosensitive layer prior to charging performed by the charging means to uniformize a surface potential of the photosensitive layer;

light radiation means for radiating light to a charging area of the photosensitive layer in the state of being charged by the charging means and for adjusting the amount of the light to be radiated;

exposing means for radiating light corresponding to an image toward the photosensitive layer in the state of being charged;

developing means located downstream with respect to the exposing means in the rotation direction of the photosensitive member;

operation means for outputting an adjusting signal for setting at least one of a charging potential of the photosensitive layer and a sensitivity of the photosensitive layer at one of at least two different values determined in advance; and compensation means for setting at least one of the charging potential of the photosensitive layer and the sensitivity of the photosensitive layer at the one of the at least two different values by adjusting the amount of light radiated toward the charging area by the light radiation means based on the adjusting signal, at least one of the at least two different values determined in advance being selected so as to change a gamma characteristic of the photosensitive layer with respect to the image, wherein the light radiation means includes light emitting means which is different from the charge removing means, the charging means includes a discharge member for performing discharge toward the photosensitive layer and a first case surrounding the discharge member and opened toward the photosensitive layer, the light radiation means includes a light emitting member and a second case surrounding the light emitting member and opened toward the charging area of the photosensitive layer, and the first case and the second case have a common part.

16. An image forming apparatus according to claim 15, wherein the sensitivity of the photosensitive layer is set at two different values by the compensation means.

17. An image forming apparatus according to claim 15, wherein the sensitivity of the photosensitive layer set by the compensation means is selected from at least three different values.

18. An image forming apparatus according to claim 15, wherein the light radiation means generates light as pulses.

19. An image forming apparatus according to claim 15, wherein the compensation means includes light emission driving means for driving the light radiation means and light amount setting means for setting the amount of light radiated by the light radiation means.

* * * * *